US010436229B2

(12) United States Patent
Hijikata et al.

(10) Patent No.: US 10,436,229 B2
(45) Date of Patent: Oct. 8, 2019

(54) HYDRAULIC DRIVE SYSTEM FOR WORK MACHINE

(71) Applicant: Hitachi Construction Machinery Co., Ltd., Taito-ku, Tokyo (JP)

(72) Inventors: Seiji Hijikata, Tsukuba (JP); Kouji Ishikawa, Kasumigaura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 83 days.

(21) Appl. No.: 15/504,993

(22) PCT Filed: Sep. 29, 2015

(86) PCT No.: PCT/JP2015/077581
§ 371 (c)(1),
(2) Date: Feb. 17, 2017

(87) PCT Pub. No.: WO2016/052541
PCT Pub. Date: Apr. 7, 2016

(65) Prior Publication Data

US 2017/0276155 A1 Sep. 28, 2017

(30) Foreign Application Priority Data

Oct. 2, 2014 (JP) ..... 2014-204349

(51) Int. Cl.
*F15B 21/14* (2006.01)
*E02F 9/22* (2006.01)
(Continued)

(52) U.S. Cl.
CPC ..... *F15B 21/14* (2013.01); *E02F 9/2004* (2013.01); *E02F 9/22* (2013.01); *E02F 9/2217* (2013.01);
(Continued)

(58) Field of Classification Search
CPC .... F15B 13/07; F15B 13/06; F15B 2211/761; F15B 2211/88; F15B 21/14; E02F 9/2217
(Continued)

(56) References Cited

U.S. PATENT DOCUMENTS 6,502,393 B1 * 1/2003 Stephenson ..... F15B 11/006 60/414
6,877,417 B2 * 4/2005 Shimada ..... E02F 9/2217 91/433
(Continued)

FOREIGN PATENT DOCUMENTS

CN 1753831 A 3/2006
CN 101091065 A 12/2007
(Continued)

OTHER PUBLICATIONS

International Search Report (PCT/ISA/210) issued in PCT Application No. PCT/JP2015/077581 dated Dec. 28, 2015 with English translation (5 pages).
(Continued)

*Primary Examiner* — Thomas E Lazo
*Assistant Examiner* — Michael Quandt
(74) *Attorney, Agent, or Firm* — Crowell & Moring LLP

(57) ABSTRACT

Provided is a hydraulic drive system for a work machine configured with a single solenoid proportional valve for a regeneration circuit, wherein substantially the same actuator speed can be secured irrespective of whether or not hydraulic fluid discharged from a hydraulic actuator is regenerated for driving of another hydraulic actuator. The hydraulic drive system includes: a regeneration line that connects a bottom-side hydraulic chamber of a hydraulic cylinder 4 to a portion between a hydraulic pump device 50 and a second hydraulic actuator 8, and a regeneration flow rate adjustment device that supplies, at an adjusted flow rate, at least part of
(Continued)

the discharged hydraulic fluid to a portion between the hydraulic pump device 50 and the second hydraulic actuator; a discharge flow rate adjustment device that discharges, at an adjusted flow rate, the discharged hydraulic fluid to a tank; one electric drive device 22 that simultaneously controls the regeneration flow rate adjustment device and the discharge flow rate adjustment device; and a control unit 27 that outputs a control command to the electric drive device in such a manner that falling speed of a first driven body does not vary significantly, irrespective of the magnitude of the regeneration flow rate caused by the regeneration flow rate adjustment device.

2 Claims, 9 Drawing Sheets

(51) Int. Cl.

| | |
|---|---|
| ***E02F 9/20*** | (2006.01) |
| ***F15B 11/16*** | (2006.01) |
| ***F15B 11/044*** | (2006.01) |
| ***F15B 11/05*** | (2006.01) |
| ***F15B 21/08*** | (2006.01) |
| *F15B 11/024* | (2006.01) |
| *F15B 13/07* | (2006.01) |
| *E02F 3/32* | (2006.01) |

(52) U.S. Cl.
CPC ..... *E02F 9/2232* (2013.01); *E02F 9/2271* (2013.01); *E02F 9/2296* (2013.01); *F15B 11/044* (2013.01); *F15B 11/05* (2013.01); *F15B 11/16* (2013.01); *F15B 21/087* (2013.01); *E02F 3/32* (2013.01); *E02F 9/2267* (2013.01); *E02F 9/2285* (2013.01); *F15B 13/07* (2013.01); *F15B 2011/0243* (2013.01); *F15B 2211/20546* (2013.01); *F15B 2211/3058* (2013.01); *F15B 2211/30595* (2013.01); *F15B 2211/40515* (2013.01); *F15B 2211/41581* (2013.01); *F15B 2211/426* (2013.01); *F15B 2211/428* (2013.01); *F15B 2211/455* (2013.01); *F15B 2211/46* (2013.01); *F15B 2211/50518* (2013.01); *F15B 2211/5159* (2013.01); *F15B 2211/6309* (2013.01); *F15B 2211/6313* (2013.01); *F15B 2211/6316* (2013.01); *F15B 2211/6336* (2013.01); *F15B 2211/6652* (2013.01); *F15B 2211/6654* (2013.01); *F15B 2211/6658* (2013.01); *F15B 2211/7053* (2013.01); *F15B 2211/71* (2013.01); *F15B 2211/7142* (2013.01); *F15B 2211/761* (2013.01); *F15B 2211/88* (2013.01)

(58) Field of Classification Search
USPC ..... 60/424; 91/520, 531, 515
See application file for complete search history.

(56) References Cited

U.S. PATENT DOCUMENTS

| | | | | |
|---|---|---|---|---|
| 9,422,689 | B2 * | 8/2016 | Wu | E02F 9/2091 |
| 9,903,393 | B2 * | 2/2018 | Wu | E02F 9/2282 |
| 2008/0110166 | A1 | 5/2008 | Stephenson et al. | |
| 2011/0197576 | A1 | 8/2011 | Wada et al. | |
| 2012/0304630 | A1 | 12/2012 | Kawasaki et al. | |
| 2014/0090367 | A1 | 4/2014 | Hijikata et al. | |
| 2014/0102289 | A1 * | 4/2014 | Wu | E02F 9/2091 91/466 |
| 2015/0007557 | A1 | 1/2015 | Egawa et al. | |
| 2016/0376770 | A1 * | 12/2016 | Matsuzaki | E02F 9/2217 60/414 |

FOREIGN PATENT DOCUMENTS

| | | | |
|---|---|---|---|
| CN | 102182730 | A | 9/2011 |
| CN | 102203434 | A | 9/2011 |
| CN | 102733443 | A | 10/2012 |
| CN | 103597220 | A | 2/2014 |
| CN | 103608526 | A | 2/2014 |
| EP | 1 600 419 | A1 | 11/2005 |
| JP | 2010-190261 | A | 9/2010 |
| JP | 2013-53498 | A | 3/2013 |
| JP | 5296570 | B2 | 9/2013 |
| JP | 5301601 | B2 | 9/2013 |
| JP | 2013-200023 | A | 10/2013 |
| KR | 10-2012-0092173 | A | 8/2012 |
| KR | 10-2014-0021024 | A | 2/2014 |

OTHER PUBLICATIONS

Japanese-language Written Opinion (PCT/ISA/237) issued in PCT Application No. PCT/JP2015/077581 dated Dec. 28, 2015 (3 pages).
International Preliminary Report on Patentability (PCT/IB/338 & PCT/IB/373) issued in PCT Application No. PCT/JP2015/077581 dated Apr. 13, 2017, including English translation of document C2 (Japanese-language Written Opinion (PCT/ISA/237)) previously filed on Feb. 17, 2017(6 pages).
Chinese-language Office Action issued in counterpart Chinese Application No. 201580042936.3 dated Sep. 21, 2017 (6 pages).

* cited by examiner

HYDRAULIC DRIVE SYSTEM FOR WORK MACHINE

TECHNICAL FIELD

The present invention relates to a hydraulic drive system for a work machine. More particularly, the invention relates to a hydraulic drive system for a work machine, such as a hydraulic excavator, having a regeneration circuit by which hydraulic fluid discharged from a hydraulic actuator due to inertial energy of a driven member (e.g., boom), such as falling of the driven member by its own weight, is reused (regenerated) for driving of another actuator.

BACKGROUND ART

There has been known a hydraulic drive system for a work machine having a regeneration circuit by which hydraulic fluid discharged from a boom cylinder due to falling of a boom by its own weight is regenerated, for example, for an arm cylinder, and examples thereof are described in Patent Documents 1 and 2. In the hydraulic drive system described in Patent Document 1, at the time of regeneration of the hydraulic fluid discharged from a bottom-side hydraulic chamber of the boom cylinder for the arm cylinder, delivery flow rate of a hydraulic pump for supplying the hydraulic fluid to the arm cylinder is reduced by an amount according to the regeneration, so as to improve the fuel cost for an engine.

Besides, in the hydraulic drive system described in Patent Document 2, the hydraulic fluid discharged from a bottom-side hydraulic chamber of the boom cylinder is regenerated for the arm cylinder through a center bypass line on the basis of judgment that a predetermined condition is established, whereby a hydraulic circuit is prevented from becoming large in size or complicated in structure.

PRIOR ART DOCUMENTS

Patent Documents

Patent Document 1: Japanese Patent No. 5296570
Patent Document 2: Japanese Patent No. 5301601

SUMMARY OF THE INVENTION

Problem to be Solved by the Invention

In the hydraulic drive system of Patent Document 1, the delivery flow rate of the hydraulic pump is reduced by an amount according to the regeneration of the hydraulic fluid from the bottom-side hydraulic chamber of the boom cylinder to the arm cylinder, so as to improve the fuel cost. Therefore, energy savings can be realized. However, two solenoid proportional valves, namely, a solenoid proportional valve for controlling a regeneration valve and a solenoid proportional valve for controlling a meter-out valve are needed. This leads to a problem that mountability of the system onto the work machine is worsened, and the manufacturing cost is increased.

On the other hand, the hydraulic drive system of Patent Document 2 is configured using a single solenoid proportional valve, and is therefore free from the above-mentioned problem.

However, the hydraulic drive system of Patent Document 2 has a problem as follows. In the case where the predetermined condition is not established and regeneration is not conducted, the flow rate of the hydraulic fluid discharged from the bottom-side hydraulic chamber of the boom cylinder is adjusted by a single flow control valve. On the other hand, where the condition is established, the hydraulic fluid discharged from the bottom-side hydraulic chamber of the boom cylinder is supplied to the center bypass line through another flow control valve in addition to the above-mentioned flow control valve. In the case where the regeneration is performed, therefore, there is a possibility that the flow rate of the discharged hydraulic fluid increases and the piston rod speed of the boom cylinder increases, as compared to the case where the regeneration is not performed. This increase in the piston rod speed of the boom cylinder may give the operator an uncomfortable feeling in regard of operability, depending on whether or not the regeneration is performed.

The present invention has been made on the basis of the foregoing. Accordingly, it is an object of the present invention to provide a hydraulic drive system for a work machine configured with a single solenoid proportional valve (electric drive device) for a regeneration circuit, wherein substantially the same actuator speed can be secured irrespective of whether or not hydraulic fluid discharged from a hydraulic actuator is regenerated for driving of another hydraulic actuator.

Means for Solving the Problems

To achieve the above object, according to a first-named invention, there is provided a hydraulic drive system for a work machine, including: a hydraulic pump device; a first hydraulic actuator that is supplied with hydraulic fluid from the hydraulic pump device and drives a first driven body; a second hydraulic actuator that is supplied with the hydraulic fluid from the hydraulic pump device and drives a second driven body; a first flow rate adjustment device that controls flow of the hydraulic fluid supplied from the hydraulic pump device to the first hydraulic actuator; a second flow rate adjustment device that controls flow of the hydraulic fluid supplied from the hydraulic pump device to the second hydraulic actuator; a first operation device that outputs an operation signal for commanding an operation of the first driven body and switches over the first flow rate adjustment device; and a second operation device that outputs an operation signal for commanding an operation of the second driven body and switches over the second flow rate adjustment device, the first hydraulic actuator being a hydraulic cylinder that discharges the hydraulic fluid from a bottom-side hydraulic chamber and sucks the hydraulic fluid into a rod-side hydraulic chamber by falling of the first driven body by its own weight when the first operation device is operated in the direction of falling of the first driven body by its own weight, wherein the hydraulic drive system includes: a regeneration line that connects the bottom-side hydraulic chamber of the hydraulic cylinder to a portion between the hydraulic pump device and the second hydraulic actuator; a regeneration flow rate adjustment device that supplies, at an adjusted flow rate, at least part of the hydraulic fluid discharged from the bottom-side hydraulic chamber of the hydraulic cylinder to a portion between the hydraulic pump device and the second hydraulic actuator through the regeneration line; a discharge flow rate adjustment device that discharges, at an adjusted flow rate, at least part of the hydraulic fluid discharged from the bottom-side hydraulic chamber of the hydraulic cylinder to a tank; one electric drive device that simultaneously controls the regeneration flow rate adjustment device and the discharge flow rate adjustment device; and a control unit that outputs a control command to the electric drive device such that a falling speed of the first driven body is substantially the same irrespective of the magnitude of the regeneration flow rate caused by the regeneration flow rate adjustment device.

Effect of the Invention

According to the present invention, substantially the same actuator speed can be secured irrespective of whether or not hydraulic fluid discharged from a hydraulic actuator is regenerated for driving of another hydraulic actuator, and the system can be configured with a single solenoid proportional valve (electric drive device) for a regeneration circuit. As a result, a favorable operability can be realized, and a reduction in cost and enhanced mountability can be realized.

MODES FOR CARRYING OUT THE INVENTION

Figure 1:
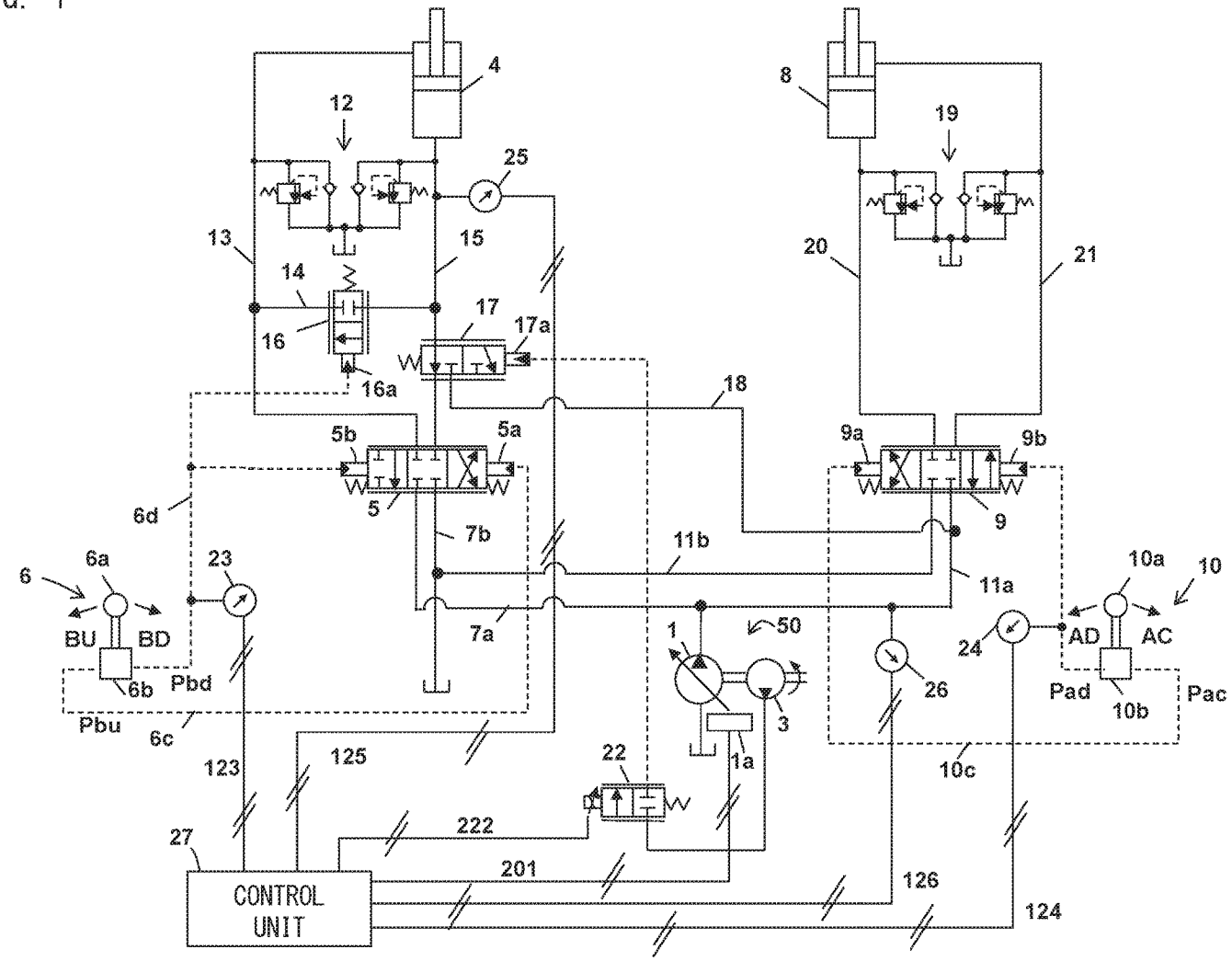
FIG. 1 is a schematic drawing of a control system showing a first embodiment of a hydraulic drive system for a work machine of the present invention.

Embodiments of a hydraulic drive system for a work machine of the present invention will be described below, referring to the drawings.

Embodiment 1

FIG. 1 is a schematic drawing of a control system showing a first embodiment of the hydraulic drive system for a work machine of the present invention.

In FIG. 1, a hydraulic drive system in the present embodiment includes: a pump device 50 including a main hydraulic pump 1 and a pilot pump 3; a boom cylinder 4 (first hydraulic actuator) that is supplied with hydraulic fluid from the hydraulic pump 1 and drives a boom 205 (see FIG. 2) of a hydraulic excavator which is a first driven body; an arm cylinder 8 (second hydraulic actuator) that is supplied with the hydraulic fluid from the hydraulic pump 1 and drives an arm 206 (see FIG. 2) of the hydraulic excavator which is a second driven body; a control valve 5 (first flow rate adjustment device) that controls flow (flow rate and direction) of the hydraulic fluid supplied from the hydraulic pump 1 to a boom cylinder 4; a control valve 9 (second flow rate adjustment device) that controls flow (flow rate and direction) of the hydraulic fluid supplied from the hydraulic pump 1 to an arm cylinder 8; a first operation device 6 that outputs an operation command for a boom and switches over the control valve 5; and a second operation device 10 that outputs an operation command for an arm and switches over the control valve 9. The hydraulic pump 1 is connected also to control valves not shown in the drawing such that the hydraulic fluid is supplied also to other actuators not shown in the drawing, but circuit portions therefor are omitted in the drawing.

The hydraulic pump 1 is of a variable displacement type, and has a regulator 1*a*. The regulator 1*a* is controlled by a control signal from a control unit 27 (described later), whereby tilting angle (capacity) of the hydraulic pump 1 is controlled, and delivery flow rate of the hydraulic pump 1 is controlled. In addition, though not shown, the regulator 1*a*, as well known, has a torque control section to which delivery pressure of the hydraulic pump 1 is introduced and which limits the tilting angle (capacity) of the hydraulic pump 1 such that absorption torque of the hydraulic pump 1 does not exceed a preset maximum torque. The hydraulic pump 1 is connected to the control valves 5 and 9 through hydraulic fluid supply lines 7*a* and 11*a*, and the hydraulic fluid delivered from the hydraulic pump 1 is supplied to the control valves 5 and 9.

The control valves 5 and 9, which are flow rate adjustment devices, are connected to bottom-side hydraulic chambers or rod-side hydraulic chambers of the boom cylinder 4 and the arm cylinder 8 through bottom-side lines 15 and 20 or rod-side lines 13 and 21. The hydraulic fluid delivered from the hydraulic pump 1 is supplied to the bottom-side hydraulic chambers or the rod-side hydraulic chambers of the boom cylinder 4 and the arm cylinder 8 from the control valves 5 and 9 through the bottom-side lines 15 and 20 or the rod-side lines 13 and 21, according to switched positions of the control valves 5 and 9. At least part of the hydraulic fluid discharged from the boom cylinder 4 is returned to a tank from the control valve 5 through a tank line 7*b*. The hydraulic fluid discharged from the arm cylinder 8 is entirely returned to the tank from the control valve 9 through a tank line 11*b*.

Note that a case wherein the flow rate adjustment device for controlling the flow (flow rate and direction) of the hydraulic fluid supplied from the hydraulic pump 1 to each hydraulic actuator 4, 8 is respectively composed of one control valve 5, 9 is described as an example in the present embodiment, but this configuration is not restrictive. The flow rate adjustment device may be configured such that supply of the hydraulic fluid is performed by a plurality of valves, or may be configured such that supply and discharge of the hydraulic fluid are performed by separate valves.

The first and second operation devices 6 and 10 have operation levers 6*a* and 10*a*, and pilot valves 6*b* and 10*b*, respectively. The pilot valves 6*b* and 10*b* are connected to operation sections 5*a* and 5*b* of the control valve 5 and operation sections 9*a* and 9*b* of the control valve 9 through pilot lines 6*c* and 6*d* and pilot lines 10*c* and 10*d*, respectively.

When the operation lever 6*a* is operated in a boom raising direction BU (the leftward direction in the figure), the pilot valve 6*b* generates an operation pilot pressure Pbu according to an operation amount of the operation lever 6*a*. This operation pilot pressure Pbu is transmitted through the pilot line 6*c* to the operation section 5*a* of the control valve 5, whereby the control valve 5 is switched in a boom raising direction (to a position on the right side in the drawing). When the operation lever 6*a* is operated in a boom lowering direction BD (the rightward direction in the figure), the pilot valve 6*b* generates an operation pilot pressure Pbd according to an operation amount of the operation lever 6*a*. This operation pilot pressure Pbd is transmitted through the pilot line 6*d* to the operation section 5*b* of the control valve 5, whereby the control valve 5 is switched in a boom lowering direction (to a position on the left side in the drawing).

When the operation lever 10*a* is operated in an arm crowding direction AC (the rightward direction in the figure), the pilot valve 10*b* generates an operation pilot pressure Pac according to an operation amount of the operation lever 10*a*. This operation pilot pressure Pac is transmitted through the pilot line 10*c* to the operation section 9*a* of the control valve 9, whereby the control valve 9 is switched in an arm crowding direction (to a position on the left side in the drawing). When the operation lever 10*a* is operated in an arm dumping direction AD (the leftward direction in the figure), the pilot valve 10*b* generates an operation pilot pressure Pad according to an operation amount of the operation lever 10*a*. This operation pilot pressure Pad is transmitted through the pilot line 10*d* to the operation section 9*b* of the control valve 9, whereby the operation valve 9 is switched in an arm dumping direction (to a position on the right side in the drawing).

To a portion between the bottom-side line 15 and the rod-side line 13 of the boom cylinder 4 and to a portion between the bottom-side line 20 and the rod-side line 21 of the arm cylinder 8, over-load relief valves with make-up 12 and 19 are connected, respectively. The over-load relief valves with make-up 12 and 19 have a function of preventing hydraulic circuit devices from being damaged due to an excessive rise in pressure in the bottom-side lines 15 and 20 and the rod-side lines 13 and 21, and a function of suppressing the possibility of generation of cavitation due to occurrence of a negative pressure in the bottom-side lines 15 and 20 and the rod-side lines 13 and 21.

Note that the present embodiment concerns a case where the pump device 50 includes one main pump (hydraulic pump 1), but a configuration may also be adopted wherein the pump device 50 includes multiple (for example, two) main pumps, the main pumps are connected separately to the control valves 5 and 9, and hydraulic fluid is supplied to the boom cylinder 4 and the arm cylinder 8 from the separate main pumps.

Figure 2:
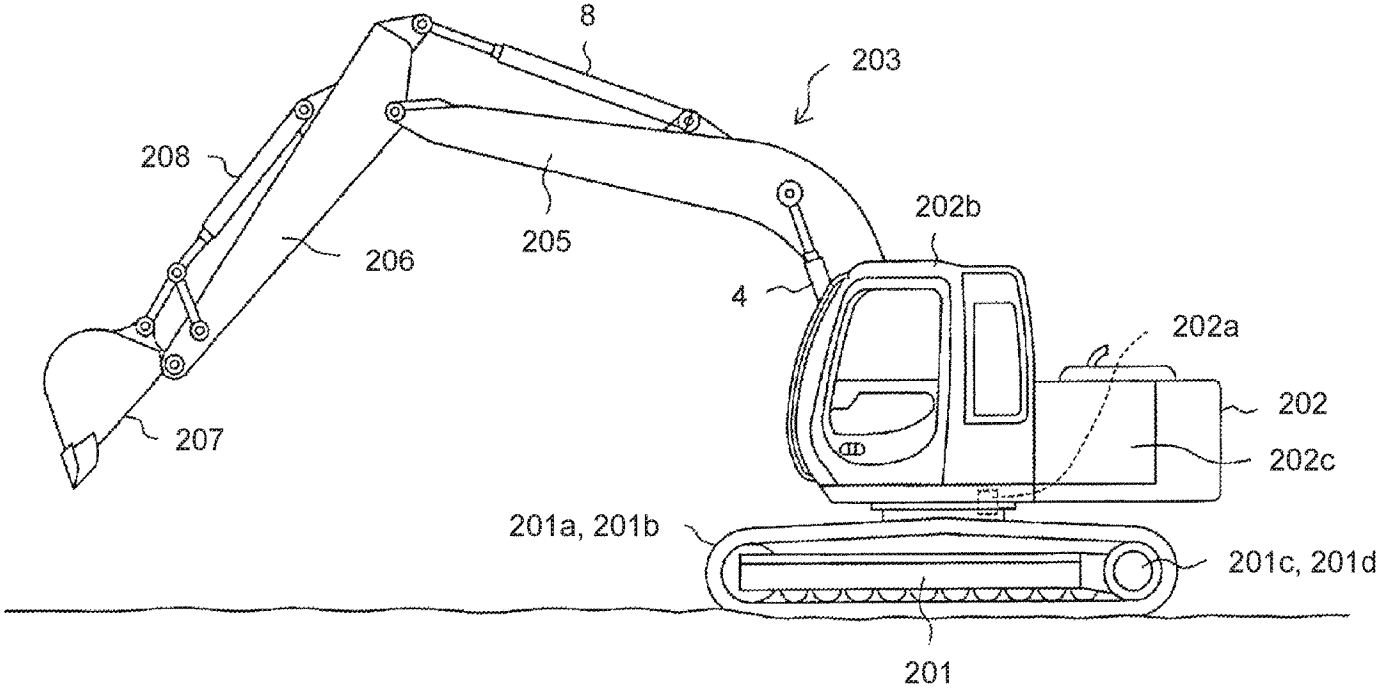
FIG. 2 is a side view showing a hydraulic excavator having mounted thereon the first embodiment of the hydraulic drive system for a work machine of the present invention.

FIG. 2 is a side view showing a hydraulic excavator having mounted thereon the first embodiment of the hydraulic drive system for a work machine of the present invention.

The hydraulic excavator includes a lower track structure 201, an upper swing structure 202, and a front work implement 203. The lower track structure 201 has left and right crawler type track devices 201*a*, 201*a* (only one of them is shown), which are driven by left and right track motors 201*b*, 201*b* (only one of them is shown). The upper swing structure 202 is swingably mounted on the lower track structure 201, and is driven to swing by a swing motor 202*a*. The front work implement 203 is elevatably mounted to a front portion of the upper swing structure 202. The upper swing structure 202 is provided with a cabin (operation room) 202*b*, in which operation devices such as the first and second operation devices 6 and 10 and a track operation pedal device which is not shown are disposed.

The front work implement 203 is an articulated structure including a boom 205 (first driven body), an arm 206 (second driven body), and a bucket 207. The boom 205 is turned up and down in relation to the upper swing structure 202 by extension/contraction of the boom cylinder 4. The arm 206 is turned up and down and forward and rearward in relation to the boom 205 by extension/contraction of the arm cylinder 8. The bucket 207 is turned up and down and forward and rearward in relation to the arm 206 by extension/contraction of a bucket cylinder 208.

In FIG. 1, circuit portions associated with hydraulic actuators such as the left and right track motors 201*b*, 201*b*, the swing motor 202*a*, and the bucket cylinder 208 are omitted.

Here, the boom cylinder 4 is a hydraulic cylinder that discharges hydraulic fluid from the bottom-side hydraulic chamber and sucks the hydraulic fluid into the rod-side hydraulic chamber by falling of the front work implement 203 inclusive of the boom 205 by its own weight when the operation lever 6*a* of the first operation device 6 is operated in the boom lowering direction (the direction of falling of the first driven body by its own weight) BD.

Returning to FIG. 1, in addition to the above-mentioned components, the hydraulic drive system of the present invention includes: a 2-position 3-port regeneration control valve 17 that is disposed in the bottom-side line 15 of the boom cylinder 4 and enables the flow rate of the hydraulic fluid discharged from the bottom-side hydraulic chamber of the boom cylinder 4 to be distributed, in an adjusted manner, to the control valve 5 side (the tank side) and to the hydraulic fluid supply line 11*a* side (the regeneration line side) of the arm cylinder 8; a regeneration line 18 that is connected on one side thereof to an outlet port on one side of the regeneration control valve 17 and is connected on the other side thereof to the hydraulic fluid supply line 11*a*; a communication line 14 that is branched respectively from the bottom-side line 15 and the rod-side line 13 of the boom cylinder 4 and interconnects the bottom-side line 15 and the rod-side line 13; a communication control valve 16 that is disposed in the communication line 14, is opened based on the operation pilot pressure Pbd (operation signal) in the boom lowering direction BD of the first operation device 6, regenerates and supplies part of the hydraulic fluid discharged from the bottom-side hydraulic chamber of the boom cylinder 4 to the rod-side hydraulic chamber of the boom cylinder 4, and makes communication between the bottom-side hydraulic chamber and the rod-side hydraulic chamber of the boom cylinder 4 to thereby prevent a negative pressure from being generated in the rod-side hydraulic chamber; a solenoid proportional valve 22; pressure sensors 23, 24, 25, and 26; and the control unit 27.

The regeneration control valve 17 has a tank-side line (first restrictor) and a regeneration-side line (second restrictor) such that the hydraulic fluid discharged from the bottom-side hydraulic chamber of the boom cylinder 4 can be made to flow to the tank side (the control valve 5 side) and the regeneration line 18 side. The stroke of the regeneration control valve 17 is controlled by one solenoid proportional valve 22 (electric drive device). An outlet port on the other side of the regeneration control valve 17 is connected with a port of the control valve 5. In the present embodiment, the regeneration control valve 17 constitutes a regeneration flow rate adjustment device that supplies, at an adjusted flow rate, at least part of the hydraulic fluid discharged from the bottom-side hydraulic chamber of the boom cylinder 4 to a portion between the hydraulic pump 1 and the arm cylinder 8 through the regeneration line 18, and a discharge flow rate adjustment device that discharges, at an adjusted flow rate, at least part of the hydraulic fluid discharged from the bottom-side hydraulic chamber of the boom cylinder 4 to the tank.

The communication control valve 16 has an operation section 16*a*, and is opened by transmission of the operation pilot pressure Pbd in the boom lowering direction BD of the first operation device 6 to the operation section 16*a*.

The pressure sensor 23 is connected to the pilot line 6*d*, and detects the operation pilot pressure Pbd in the boom lowering direction BD of the first operation device 6. The pressure sensor 25 is connected to the bottom-side line 15 of the boom cylinder 4, and detects the pressure in the bottom-side hydraulic chamber of the boom cylinder 4. The pressure sensor 26 is connected to the hydraulic fluid supply line 11*a* on the arm cylinder 8 side, and detects the delivery pressure of the hydraulic pump 1. The pressure sensor 24 is connected to the pilot line 10*d* of the second operation device 10, and detects the operation pilot pressure Pad in the arm dumping direction of the second operation device 10.

The control unit 27 accepts as inputs detection signals 123, 124, 125, and 126 from the pressure sensors 23, 24, 25, and 26, performs predetermined calculations based on the signals, and outputs control commands to the solenoid proportional valve 22 and the regulator 1*a*.

The solenoid proportional valve 22 as an electric drive device is operated by the control command from the control unit 27. The solenoid proportional valve 22 converts a primary pressure of the hydraulic fluid supplied from the pilot pump 3 as a pilot hydraulic fluid source into a desired pressure (secondary pressure) and outputs it to an operation section 17*a* of the regeneration control valve 17 to control the stroke of the regeneration control valve 17, thereby controlling the opening (opening area) of the regeneration control valve 17.

Figure 3:
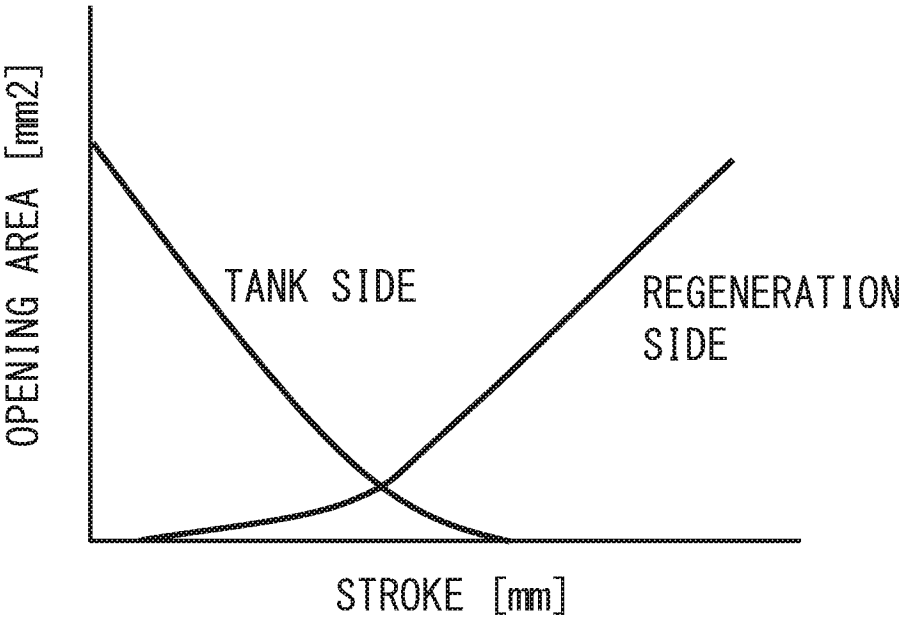
FIG. 3 is a characteristic diagram showing opening area characteristic of a regeneration control valve constituting the first embodiment of the hydraulic drive system for a work machine of the present invention.

FIG. 3 is a characteristic diagram showing opening area characteristic of the regeneration control valve constituting the first embodiment of the hydraulic drive system for a work machine of the present invention. In FIG. 3, the horizontal axis represents spool stroke of the regeneration control valve 17, and the vertical axis represents opening area of the regeneration control valve 17.

In FIG. 3, in the case where the spool stroke is at a minimum (in the case where the spool is in a normal position), the tank-side line is open and its opening area is at a maximum, whereas the regeneration-side line is closed and its opening area is zero. As the stroke is gradually increased, the opening area of the tank-side line is gradually decreased, whereas the regeneration-side line is opened and its opening area is gradually increased. With the stroke further increased, the tank-side line is closed (its opening area is reduced to zero), whereas the opening area of the regeneration-side line is further increased. As a result of such a configuration, in the case where the spool stroke is at a minimum, the hydraulic fluid discharged from the bottom-side hydraulic chamber of the boom cylinder 4 wholly flows to the control valve 5 side, without being regenerated, and, when the stroke is gradually moved rightward, part of the hydraulic fluid discharged from the bottom-side hydraulic chamber of the boom cylinder 4 flows into the regeneration line 18. In addition, with the stroke adjusted, the opening areas of the tank-side line and the regeneration-side line 18 can be varied, and the regeneration flow rate can be controlled.

Operations conducted in the case where only boom lowering is performed will be outlined below.

In FIG. 1, in the case where the operation lever 6*a* of the first operation device 6 is operated in the boom lowering direction BD, the operation pilot pressure Pbd generated from the pilot valve 6*b* of the first operation device 6 is inputted to the operation section 5*b* of the control valve 5 and the operation section 16*a* of the communication control valve 16. By this, the control valve 5 is switched into a position on the left side in the figure, and communication between the bottom line 15 and the tank line 7*b* is established, whereby the hydraulic fluid is discharged from the bottom-side hydraulic chamber of the boom cylinder 4 to the tank, and a piston rod of the boom cylinder 4 performs a shrinking operation (boom lowering operation). In this instance, communication between the rod-side line 13 and the hydraulic fluid supply line 11*a* is interrupted.

Furthermore, with the communication control valve 14 switched into a communication position on the lower side in the drawing, the bottom-side line 15 of the boom cylinder 4 is made to communicate with the rod-side line 13, and part of the hydraulic fluid discharged from the bottom-side hydraulic chamber of the boom cylinder 4 is supplied to the rod-side hydraulic chamber of the boom cylinder 4. By this, generation of a negative pressure in the rod-side hydraulic chamber can be prevented; in addition, since the supply of the hydraulic fluid from the hydraulic pump 1 to the rod-side hydraulic chamber of the boom cylinder 4 is interrupted by the switching of the control valve 5, an output of the hydraulic pump 1 is suppressed, whereby fuel cost can be reduced.

Operations conducted in the case where boom lowering and arm driving are simultaneously performed will be outlined below. Note that the principle applied to the case of arm dumping and that applied to the case of arm crowding are substantially the same, and, therefore, the arm dumping operation will be described as an example.

In the case where the operation lever 6*a* of the first operation device 6 is operated in the boom lowering direction BD and the operation lever 10*a* of the second operation device 10 is simultaneously operated in an arm dumping direction AD, the operation pilot pressure Pbd generated from the pilot valve 6*b* of the first operation device 6 is inputted to the operation section 5*b* of the control rod 5 and the operation section 16*a* of the communication control valve 16. By this, the control valve 5 is switched over into a position on the left side in the figure, and the bottom line 15 is made to communicate with the tank line 7*b*, whereby the hydraulic fluid is discharged from the bottom-side hydraulic chamber of the boom cylinder 4 to the tank, and the piston rod of the boom cylinder 4 performs a shrinking operation (boom lowering operation).

The operation pilot pressure Pad generated from the pilot valve 10*b* of the second operation device 10 is inputted to the operation section 9*b* of the control valve 9. By this, the control valve 9 is switched over, to make communication between the bottom line 20 and the tank line 11*b* and communication between the rod line 21 and the hydraulic fluid supply line 11*a*, whereby the hydraulic fluid in the bottom-side hydraulic chamber of the arm cylinder 8 is discharged to the tank, and the hydraulic fluid delivered from the hydraulic pump 1 is supplied to the rod-side hydraulic chamber of the arm cylinder 8. As a result, a piston rod of the arm cylinder 8 performs a shrinking operation.

Detection signals 123, 124, 125, and 126 from the pressure sensors 23, 24, 25, and 26 are inputted to the control unit 27, and control commands are outputted to the solenoid proportional valve 22 and the regulator 1*a* of the hydraulic pump 1 by a control logic which will be described later.

The solenoid proportional valve 22 produces a control pressure (secondary pressure) according to the control command, and the regeneration control valve 17 is controlled by the control pressure, whereby part or the whole of the hydraulic fluid discharged from the bottom-side hydraulic chamber of the boom cylinder 4 is regenerated and supplied to the arm cylinder 8 through the regeneration control valve 17.

The regulator 1*a* of the hydraulic pump 1 controls the tilting angle of the hydraulic pump 1 on the basis of the control command, thereby controlling the pump flow rate appropriately such as to keep a target speed of the arm cylinder 8.

Control functions of the control unit 27 will now be described below. The control unit 27 generally has the following two functions.

First, when the first operation device 6 is operated in the boom lowering direction BD, namely, the direction of falling of the boom 205 (first driven body) by its own weight and the second operation device 10 is operated simultaneously therewith, the control unit 27 switches over the regeneration control valve 17 from the normal position, in the case where the pressure in the bottom-side hydraulic chamber of the boom cylinder 4 is higher than the pressure in the hydraulic fluid supply line 11*a* between the hydraulic pump 1 and the arm cylinder 8, whereby the hydraulic fluid discharged from the bottom-side hydraulic chamber of the boom cylinder 4 is regenerated to the rod-side hydraulic chamber of the arm cylinder. In this instance, a differential pressure between the pressure in the bottom-side hydraulic chamber of the boom cylinder 4 and the pressure in the hydraulic fluid supply line 11*a* between the hydraulic pump 1 and the arm cylinder 8 is calculated, and the opening of the regeneration control valve 17 is controlled according to the differential pressure.

Specifically, when the differential pressure is small, the stroke of the regeneration control valve 17 is reduced to throttle the opening area of the regeneration-side line and enlarge the opening area of the tank-side line. As the differential pressure increases, the opening area of the regeneration-side line is enlarged, while the opening area of the tank-side line is throttled. When the differential pressure is equal to or greater than a predetermined value, the opening of the regeneration-side line is set to a maximum value, while the tank-side opening is closed. By such a control, a shock at the time of switching of the regeneration control valve 17 is suppressed.

In the case where boom lowering and arm driving are conducted simultaneously, the differential pressure is small at the start of the process and the differential pressure increases as time passes. By gradually enlarging the opening area of the regeneration-side line according to the differential pressure, therefore, the switching shock can be suppressed, and a favorable operability can be realized.

Furthermore, in the case where the differential pressure is small, the regeneration flow rate is small even if the regeneration-side opening is enlarged, and, therefore, the speed of the piston rod of the boom cylinder may become low. In view of this, in the case where the differential pressure is small, a control is conducted wherein the opening area of the tank-side line is enlarged to increase the flow rate of the hydraulic fluid discharged from the bottom-side hydraulic chamber, thereby bringing the speed of the piston rod of the boom cylinder to a speed desired by the operator. On the other hand, in the case where the differential pressure is great, the regeneration flow rate is sufficiently great; in view of this, the opening of the tank-side line is throttled, whereby the speed of the piston rod of the boom cylinder is prevented from becoming too high.

In addition, when the hydraulic fluid is supplied from the bottom-side hydraulic chamber of the boom cylinder 4 to the hydraulic fluid supply line 11*a* between the hydraulic pump 1 and the arm cylinder 8 by controlling the regeneration control valve 17, the control unit 27 performs such a control as to reduce the capacity of the hydraulic pump 1 by an amount according to the regeneration flow rate of the hydraulic fluid supplied from the bottom-side hydraulic chamber of the boom cylinder 4 to the hydraulic fluid supply line 11*a*.

By this, substantially the same actuator speed (speed of the piston rod of the boom cylinder 4) can be secured irrespective of whether or not the hydraulic fluid discharged from the hydraulic actuator is regenerated for driving of another hydraulic actuator, and irrespectively of the magnitude of the regeneration flow rate of the hydraulic fluid. As a result, substantially the same boom falling speed can be realized in either of the cases.

Figure 4:
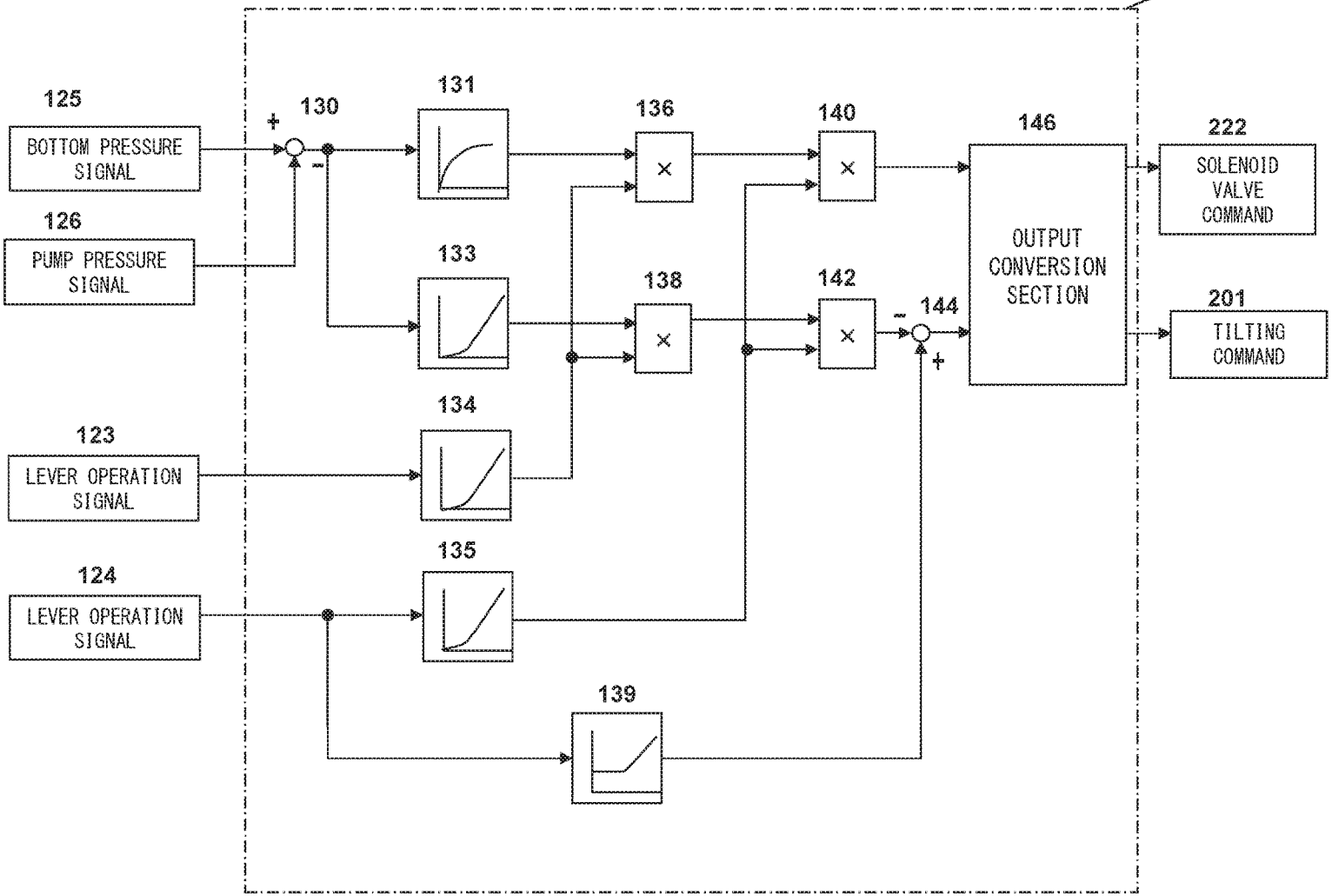
FIG. 4 is a block diagram of a control unit constituting the first embodiment of the hydraulic drive system for a work machine of the present invention.

FIG. 4 is a block diagram of the control unit constituting the first embodiment of the hydraulic drive system for a work machine of the present invention.

As shown in FIG. 4, the control unit 27 includes an adder 130, a function generator 131, a function generator 133, a function generator 134, a function generator 135, a multiplier 136, a multiplier 138, a function generator 139, a multiplier 140, a multiplier 142, an adder 144, and an output conversion section 146.

In FIG. 4, the detection signal 123 is a signal (lever operation signal) obtained by detection of the operation pilot pressure Pbd in the boom lowering direction of the operation lever 6*a* of the first operation device 6 by the pressure sensor 23. The detection signal 124 is a signal (lever operation signal) obtained by detection of the operation pilot pressure Pad in the arm dumping direction of the operation lever 10*a* of the second operation device 10 by the pressure sensor 24. The detection signal 125 is a signal (bottom pressure signal) obtained by detection of the pressure in the bottom-side hydraulic chamber of the boom cylinder 4 (the pressure in the bottom-side line 15) by the pressure sensor 25. The detection signal 126 is a signal (pump pressure signal) obtained by detection of the delivery pressure of the hydraulic pump 1 (the pressure in the hydraulic fluid supply line 11*a*) by the pressure sensor 26.

The bottom pressure signal 125 and the pump pressure signal 126 are inputted to the adder 130, in which the deviation between the bottom pressure signal 125 and the pump pressure signal 126 (the differential pressure between the pressure in the bottom-side hydraulic chamber of the boom cylinder 4 and the delivery pressure of the hydraulic pump 1) is obtained, and the differential pressure signal is inputted to the function generator 131 and the function generator 132.

The function generator 131 calculates an opening area of the regeneration-side line of the regeneration control valve 17 according to the differential pressure signal obtained by the adder 130, and its characteristic is set based on the opening area characteristic of the regeneration control valve 17 shown in FIG. 3. Specifically, in the case where the differential pressure is small, the stroke of the regeneration control valve 17 is reduced, thereby to throttle the opening area of the regeneration-side line and enlarge the opening area of the tank-side line. In the case where the differential pressure is great, on the other hand, the opening area of the regeneration line side is enlarged, and, when the differential pressure reaches a predetermined value, a control is conducted such that the opening area of the regeneration-side line is maximized and the opening of the tank-side line is closed.

The function generator 133 obtains a reduction flow rate (hereinafter referred to as pump reduction flow rate) for the hydraulic pump 1 according to the differential pressure signal obtained by the adder 130. The characteristic of the function generator 131 is set such that as the differential pressure increases, the opening area of the regeneration-side line is enlarged, thereby the regeneration flow rate is increased. This means such a setting that the pump reduction flow rate increases as the differential pressure increases.

The function generator 134 calculates a coefficient to be used in the multiplier according to the lever operation signal 123 of the first operation device 6. The function generator 134 outputs a minimum value of 0 when the lever operation signal 123 is 0, increases its output as the lever operation signal 123 increases, and outputs 1 as a maximum value.

The multiplier 136 accepts as inputs the opening area calculated by the function generator 131 and the value calculated by the function generator 134, and outputs a multiplied value as an opening area. Here, in the case where the lever operation signal 123 of the first operation device 6 is small, it is necessary to lower the piston rod speed of the boom cylinder 4, and, therefore, it is required to reduce the regeneration flow rate as well. For this reason, the function generator 134 outputs a small value within the range of 0 to 1 and the opening area calculated by the function generator 131 is brought to a further reduced value and outputted.

On the other hand, in the case where the lever operation signal 123 of the first operation device 6 is great, it is necessary to raise the piston rod speed of the boom cylinder 4, and, therefore, the regeneration flow rate can also be increased. For this reason, the function generator 134 outputs a great value within the range of 0 to 1 the reduction amount of the opening area calculated by the function generator 131 is reduced, and a greater opening area value is outputted.

The multiplier 138 accepts as inputs the pump reduction flow rate calculated by the function generator 133 and the value calculated by the function generator 134, and outputs a multiplied value as a pump reduction flow rate. Here, in the case where the lever operation signal 123 of the first operation device 6 is small, the regeneration flow rate is also small, and, therefore, it is required to set the pump reduction flow rate to a low value. For this reason, the function generator 134 outputs a small value within the range of 0 to 1 and the pump reduction flow rate calculated by the function generator 133 is brought to a further reduced value and outputted.

On the other hand, in the case where the lever operation signal 123 of the first operation device 6 is great, the regeneration flow rate is great, and it is necessary to set the pump reduction flow rate to a high value. For this reason, the function generator 134 outputs a large value within the range of 0 to 1 the reduction amount of the pump reduction flow rate calculated by the function generator 133 is reduced, and a greater pump reduction flow rate value is outputted.

The function generator 135 calculates a coefficient to be used in the multiplier according to the lever operation signal 124 of the second operation device 10. The function generator 135 outputs a minimum value of 0 when the lever operation signal 124 is 0, increases its output as the lever operation signal 124 increases, and outputs 1 as a maximum value.

The multiplier 140 accepts as inputs the opening area calculated by the multiplier 136 and the value calculated by the function generator 135, and outputs a multiplied value as an opening area. Here, in the case where the lever operation signal 124 of the second operation device 10 is small, it is necessary to lower the piston rod speed of the arm cylinder 4, and, therefore, it is required to reduce the regeneration flow rate as well. For this reason, the function generator 135 outputs a small value within the range of 0 to 1 and the opening area corrected by the multiplier 136 is brought to a further reduced value and outputted.

On the other hand, in the case where the lever operation signal 124 of the second operation device 10 is great, it is necessary to raise the piston rod speed of the arm cylinder 4, and, therefore, the regeneration flow rate can also be increased. For this reason, the function generator 135 outputs a large value within the range of 0 to 1 reduces the reduction amount of the opening area corrected by the multiplier 136, and outputs a greater opening area value.

The multiplier 142 accepts as inputs the pump reduction flow rate calculated by the multiplier 138 and the value calculated by the function generator 135, and outputs a multiplied value as a pump reduction flow rate. Here, in the case where the lever operation signal 124 of the second operation device 10 is small, the regeneration flow rate is also small, and, therefore, it is required to set the pump reduction flow rate to a low value. For this reason, the function generator 135 outputs a small value within the range of 0 to 1 and the pump reduction flow rate corrected by the multiplier 138 is brought to a further reduced value and outputted.

On the other hand, in the case where the lever operation signal 124 of the second operation device 10 is great, the regeneration flow rate is great, and, therefore, it is necessary to also set the pump reduction flow rate to a high value. For this reason, the function generator 135 outputs a large value within the range of 0 to 1 reduces the reduction amount of the pump reduction flow rate corrected by the multiplier 138, and outputs a greater pump reduction flow rate value.

Note that it is desirable to adjust each of setting tables for the function generators 131, 133, 134, and 135 in such a manner that the piston rod speed of the boom cylinder 4 does not vary significantly depending on whether or not the hydraulic fluid discharged from the bottom-side hydraulic chamber of the boom cylinder 4 is regenerated for driving of the arm cylinder 8. In addition, an operation of regenerating the hydraulic fluid discharged from the bottom-side hydraulic chamber of the boom cylinder 4 for the arm cylinder 8 is mainly a leveling operation, and, therefore, the pressure in the bottom-side hydraulic chamber of the boom cylinder 8 and the pressure in the rod-side hydraulic chamber of the arm cylinder 8 in this instance have values of a certain tendency. For this reason, by picking up the pressure in each part at the time of the leveling operation is picked up, analyzing pressure waveforms and adjusting the above-mentioned setting tables for the function generators are adjusted, the opening area of the regeneration control valve 17 can be set to an optimum value.

The function generator 139 calculates a pump required flow rate according to the lever operation signal 124 of the second operation device 10. A characteristic is set such that a minimum flow rate is outputted from the hydraulic pump 1 in the case where the lever operation signal 124 is 0. This is for improving the response characteristic at the time when the operation lever 10*a* of the second operation device 10 is operated, and for preventing seizure of the hydraulic pump 1. In addition, the delivery flow rate of the hydraulic pump 1 is increased and the flow rate of the hydraulic fluid flowing into the arm cylinder 8 is increased, as the lever operation signal 124 increases. By this, a piston rod speed of the arm cylinder 8 according to the operation amount is realized.

The pump reduction flow rate calculated by the multiplier 142 and the pump required flow rate calculated by the function generator 139 are inputted to the adder 144, in which the pump reduction flow rate, namely, the regeneration flow rate, is subtracted from the pump required flow rate, whereby a target pump flow rate is calculated.

The output conversion section 146 accepts as inputs an output from the multiplier 140 and an output from the adder 144, and outputs a solenoid valve command 222 to the solenoid proportional valve 22, and a tilting command 201 to the regulator 1*a* of the hydraulic pump 1, respectively.

By this, the solenoid proportional valve 22 converts a primary pressure of the hydraulic fluid supplied from the pilot pump 3 into a desired pressure (secondary pressure), outputs it to the operation section 17*a* of the regeneration control valve 17, so as to control the stroke of the regeneration control valve 17, thereby controlling the opening (opening area) of the regeneration control valve 17. In addition, the regulator 1*a* controls the tilting angle (capacity) of the hydraulic pump 1, whereby the delivery flow rate is controlled. As a result, the hydraulic pump 1 is controlled such as to reduce its capacity by an amount according to the regeneration flow rate of the hydraulic fluid supplied from the bottom side of the boom cylinder 4 to the hydraulic fluid supply line 11*a*.

Operations of the control unit 27 will now be described below.

With the operation lever 6*a* of the first operation device 6 operated in the boom lowering direction BD, the signal of the operation pilot pressure Pbd detected by the pressure sensor 23 is inputted to the control unit 27 as the lever operation signal 123. With the operation lever 10*a* of the second operation device 10 operated in the arm dumping direction AD, the signal of the operation pilot pressure Pad detected by the pressure sensor 24 is inputted to the control unit 27 as the lever operation signal 124. In addition, the signals of the pressure in the bottom-side hydraulic chamber of the boom cylinder 4 and the delivery pressure of the hydraulic pump 1 detected by the pressure sensors 25 and 26 are inputted to the control unit 27 as the bottom pressure signal 125 and the pump pressure signal 126.

The bottom pressure signal 125 and the pump pressure signal 126 are inputted to the adder 130, which calculates a differential pressure signal. The differential pressure signal is inputted to the function generator 131 and the function generator 133, which respectively calculate an opening area of the regeneration-side line of the regeneration control valve 17 and a pump reduction flow rate.

The lever operation signal 123 is inputted to the function generator 134, which calculates a correction signal according to the lever operation amount, and outputs the correction signal to the multiplier 136 and the multiplier 138. The multiplier 136 corrects the opening area of the regeneration-side line outputted from the function generator 131, whereas the multiplier 138 corrects the pump reduction flow rate outputted from the function generator 133.

Similarly, when the lever operation signal 124 is inputted to the function generator 135, the function generator 135 calculates a correction signal according to the lever operation amount, and outputs the correction signal to the multiplier 140 and the multiplier 142. The multiplier 140 further corrects the corrected opening area of the regeneration-side line outputted from the multiplier 136 and outputs the further corrected opening area to the output conversion section 146, whereas the multiplier 142 further corrects the corrected pump reduction flow rate outputted from the multiplier 138 and outputs the further corrected pump reduction flow rate to the adder 144.

The output conversion section 146 converts the corrected opening area of the regeneration-side line into the solenoid valve command 222, and outputs it to the solenoid proportional valve 22. By this, the stroke of the regeneration control valve 17 is controlled. As a result, the regeneration control valve 17 is set to an opening area according to the differential pressure between the pressure in the bottom-side hydraulic chamber of the boom cylinder 4 and the delivery pressure of the hydraulic pump 1, and the hydraulic fluid discharged from the bottom-side hydraulic chamber of the boom cylinder 4 is regenerated to the arm cylinder 8.

The lever operation signal 124 is inputted to the function generator 139, which calculates a pump required flow rate according to the lever operation amount, and outputs it to the adder 144.

The pump required flow rate thus calculated and the pump reduction flow rate are inputted to the adder 144, which subtracts the pump reduction flow rate, namely, the regeneration flow rate from the pump required flow rate to thereby calculate a target pump flow rate, and outputs it to the output conversion section 146.

The output conversion section 146 converts this target pump flow rate into a tilting command 201 for the hydraulic pump 1, and outputs the tilting command 201 to the regulator 1*a*. By this, the arm cylinder 8 is controlled to a desired speed according to the operation signal (operation pilot pressure Pad) of the second operation device 10, and the delivery flow rate of the hydraulic pump 1 is reduced by an amount according to the regeneration flow rate, whereby the fuel cost for an engine for driving the hydraulic pump 1 can be reduced, and energy savings can be realized.

By the above operations, the regeneration control valve 17 gradually increases the opening area of the regeneration-side line according to the differential pressure between the pressure in the bottom-side hydraulic chamber of the boom cylinder 4 and the delivery pressure of the hydraulic pump 1, and, therefore, the switching shock is suppressed, and a favorable operability can be realized. In addition, when the above-mentioned differential pressure, the operation amount of the first operation device 6 and the operation amount of the second operation device 10 are all small, the opening area of the regeneration-side line of the regeneration control valve 17 is set to be small whereas the opening area of the tank-side line is set to be large, and, therefore, the tank-side flow rate is great even though the regeneration flow rate is small. As a result, a piston rod speed of the boom cylinder desired by the operator can be secured.

On the other hand, when the differential pressure, the operation amount of the first operation device 6 and the operation amount of the second operation device 10 are large, the opening area of the regeneration-side line of the regeneration control valve 17 is set to be large whereas the opening area of the tank-side line is set to be small, and, therefore, the piston rod speed of the boom cylinder can be prevented from becoming too high, and a piston rod speed of the boom cylinder desired by the operator can be secured. In addition, the delivery flow rate of the hydraulic pump 1 is reduced according to the regeneration flow rate, whereby a piston rod speed of the arm cylinder 8 desired by the operator can also be secured.

For this reason, substantially the same actuator speed (piston rod speed of the boom cylinder 4) can be secured irrespective of whether or not the hydraulic fluid discharged from the hydraulic actuator is regenerated for driving of another hydraulic actuator, and irrespective of the magnitude of the regeneration flow rate of the hydraulic fluid. As a result, substantially the same boom falling speed can be realized in either of the cases.

According to the first embodiment of the hydraulic drive system for a work machine of the present invention described above, substantially the same actuator speed can be secured irrespective of whether or not the hydraulic fluid discharged from the hydraulic actuator 4 is regenerated for driving of another hydraulic actuator 8, and the system can be configured using the single solenoid proportional valve 22 (electric drive device) for the regeneration circuit. As a result, a favorable operability can be realized, and a reduction in cost and enhanced mountability can be realized.

Embodiment 2

Figure 5:
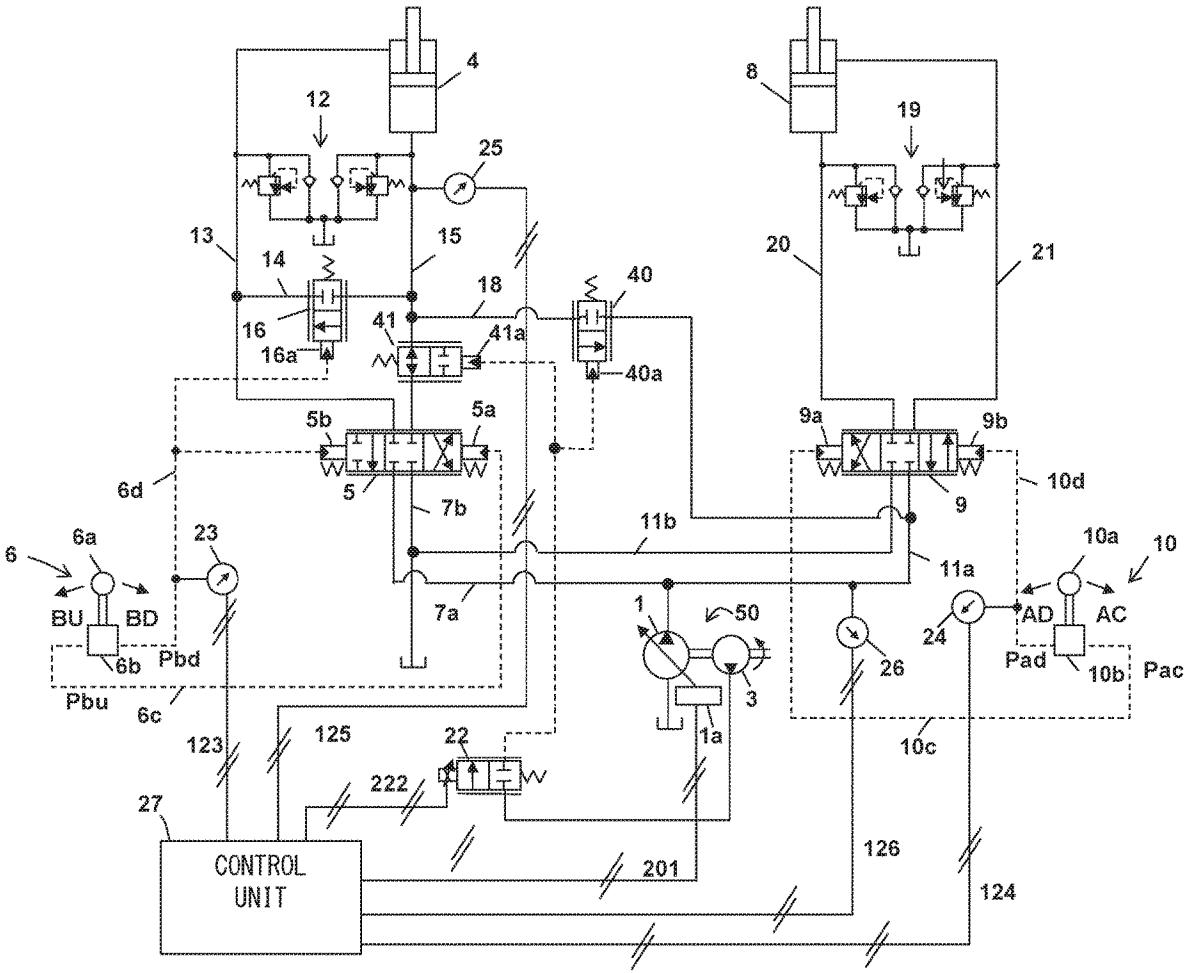
FIG. 5 is a schematic drawing of a control system showing a second embodiment of the hydraulic drive system for a work machine of the present invention.
Figure 6:
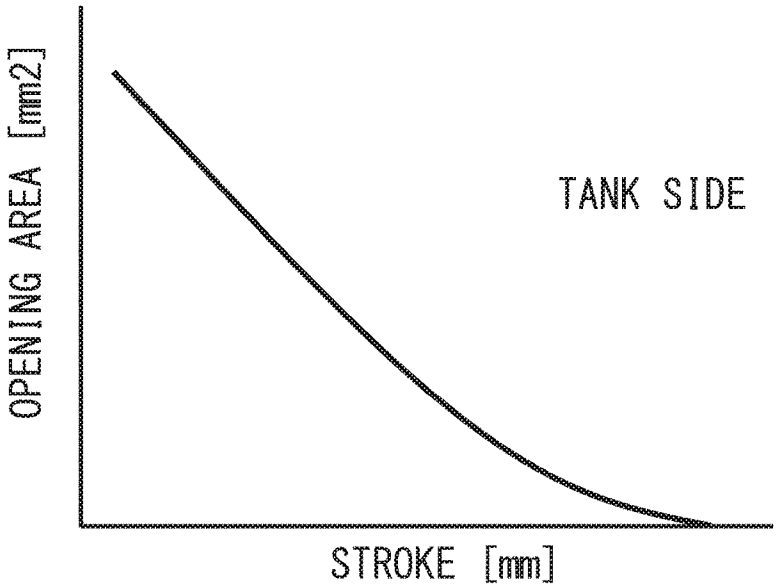
FIG. 6 is a characteristic diagram showing opening area characteristic of a tank-side control valve constituting the second embodiment of the hydraulic drive system for a work machine of the present invention.
Figure 7:
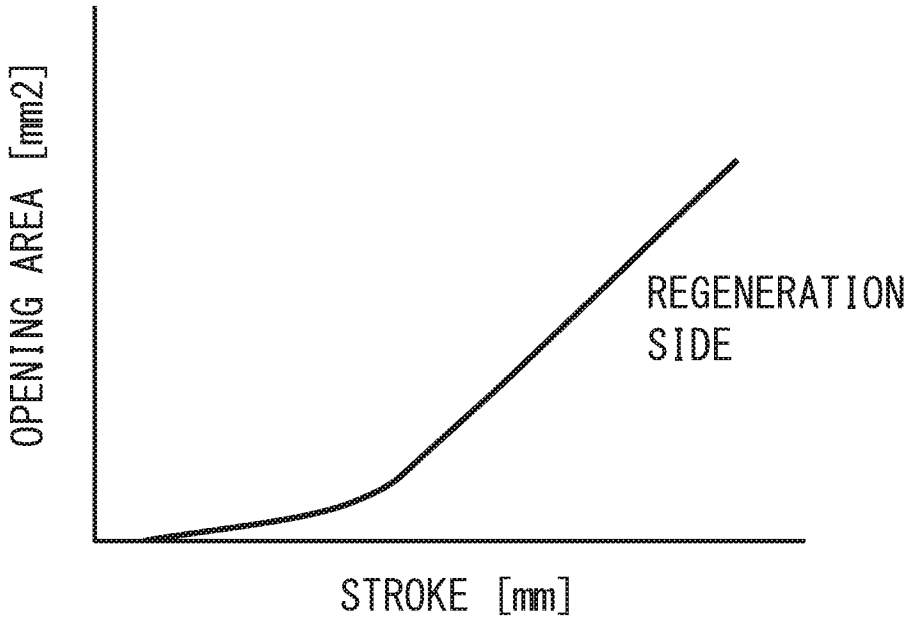
FIG. 7 is a characteristic diagram showing opening area characteristic of a regeneration-side control valve constituting the second embodiment of the hydraulic drive system for a work machine of the present invention.

A second embodiment of the hydraulic drive system for a work machine of the present invention will be described below, referring to the drawings. FIG. 5 is a schematic drawing of a control system showing the second embodiment of the hydraulic drive system for a work machine of the present invention. FIG. 6 is a characteristic diagram showing opening area characteristic of a tank-side control valve constituting the second embodiment of the hydraulic drive system for a work machine of the present invention. FIG. 7 is a characteristic diagram showing opening area characteristic of a regeneration-side control valve constituting the second embodiment of the hydraulic drive system for a work machine of the present invention. In FIGS. 5 to 7, the parts denoted by the same reference symbols as used in FIGS. 1 to 4 are the same parts as those in FIGS. 1 to 4, and, therefore, detailed descriptions of them will be omitted.

The second embodiment of the hydraulic drive system for a work machine of the present invention differs from the first embodiment in that a tank-side control valve 41 is provided as a discharge flow rate adjustment device in the bottom-side line 15, and a regeneration-side control valve 40 is provided as a regeneration flow rate adjustment device in the regeneration line 18, in place of the regeneration control valve 17 shown in FIG. 1. The stroke of the tank-side control valve 41 and the stroke of the regeneration-side control valve 40 are controlled by one solenoid proportional valve 22.

The solenoid proportional valve 22 as an electric drive device is operated by a control command from the control unit 27. The solenoid proportional valve 22 converts a primary pressure of the hydraulic fluid supplied from the pilot pump 3 into a desired pressure (secondary pressure) and outputs it to the operation section 41*a* of the tank-side control valve 41 and the operation section 40*a* of the regeneration-side control valve 40, so as to control the stroke of the tank-side control valve 41 and the stroke of the regeneration-side control valve 40, thereby controlling the openings (opening areas) of these valves.

FIG. 6 shows opening area characteristic of the tank-side control valve 41, and FIG. 7 shows opening area characteristic of the regeneration-side control valve 40. In these figures, the horizontal axis represents spool stroke of each valve, and the vertical axis represents opening area. These characteristics are formed to be equivalent to those obtained by separating the characteristic of the regeneration control valve 17 in the first embodiment shown in FIG. 3 to the tank side and the regeneration side.

In the present embodiment, the opening area of the regeneration-side line and the opening area of the tank-side line can be controlled independently, and, therefore, a further improvement in fuel cost can be realized.

According to the second embodiment of the hydraulic drive system for a work machine of the present invention as described above, substantially the same effects as those of the first embodiment described above can be obtained.

In addition, according to the second embodiment of the hydraulic drive system for a work machine of the present invention as described above, the degree of freedom in designing the opening area of the regeneration-side line and the opening area of the tank-side line is enhanced, so that a finer setting of matching can be achieved. As a result, the fuel cost reducing effect can be further enhanced.

Embodiment 3

Figure 8:
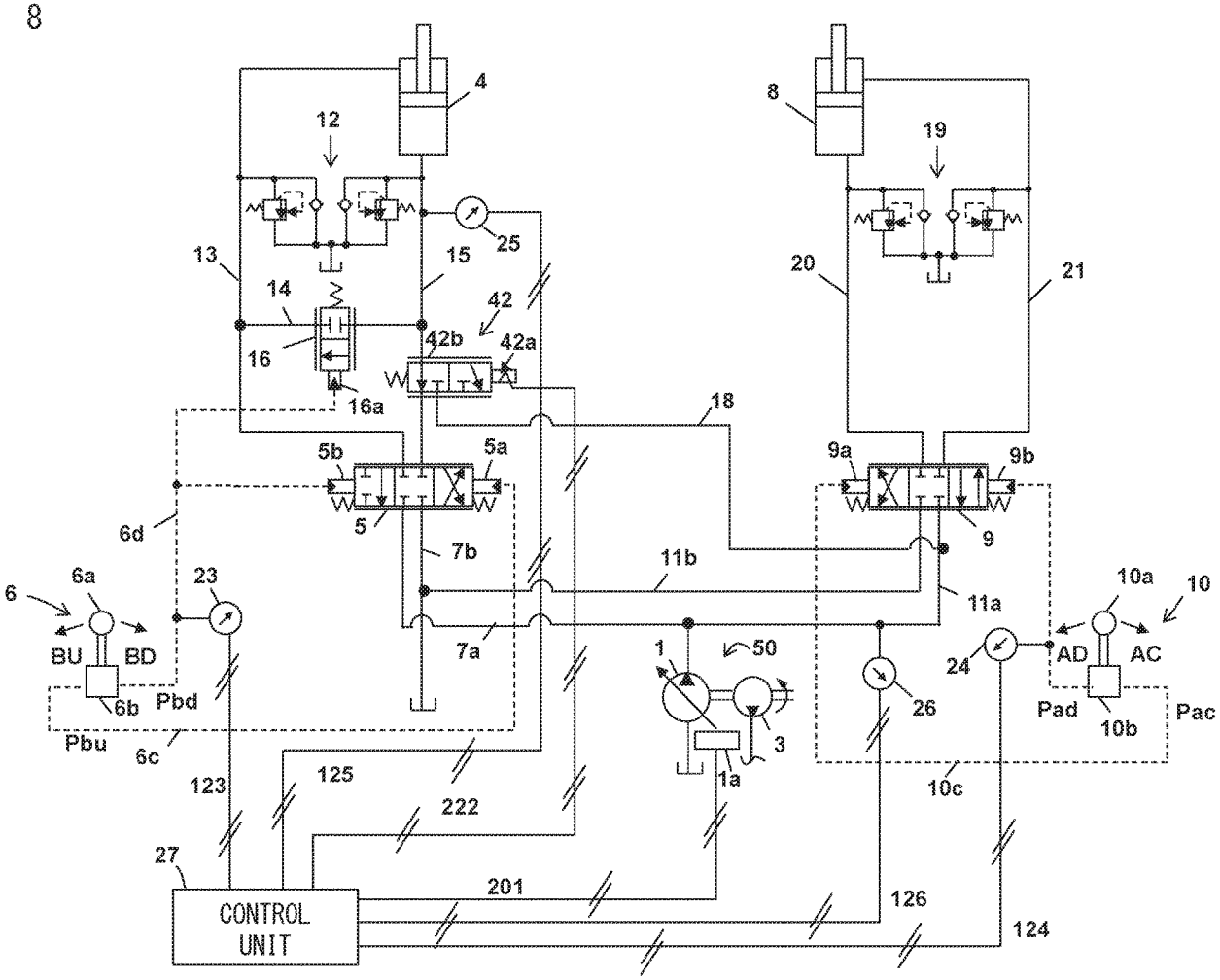
FIG. 8 is a schematic drawing of a control system showing a third embodiment of the hydraulic drive system for a work machine of the present invention.

A third embodiment of the hydraulic drive system for a work machine of the present invention will be described below, referring to the drawing. FIG. 8 is a schematic drawing of a control system showing the third embodiment of the hydraulic drive system for a work machine of the present invention. In FIG. 8, the parts denoted by the same reference symbols as used in FIGS. 1 to 7 are the same parts as those in FIGS. 1 to 7, and, therefore, detailed descriptions of them will be omitted.

The third embodiment of the hydraulic drive system for a work machine of the present invention differs from the first embodiment in that a regeneration control valve 42 composed of a solenoid proportional valve having a valve section 42B provided with the same configuration, e.g., spool, as that of the valve section of the regeneration control valve 17 and a solenoid section 42A incorporated in the valve section 42B and controlled directly by the control unit 27 is provided in place of the regeneration control valve 17 shown in FIG. 1. In the present embodiment, the solenoid section 42A corresponds to the electric drive device. In addition, a regeneration flow rate adjustment device and a discharge flow rate adjustment device are composed of the regeneration control valve 42.

In the present embodiment, it is unnecessary to dispose the solenoid proportional valve 22, and, therefore, a further enhancement of mountability can be realized.

According to the third embodiment of the hydraulic drive system for a work machine as described above, substantially the same effects as those of the first embodiment described above can be obtained.

Embodiment 4

Figure 9:
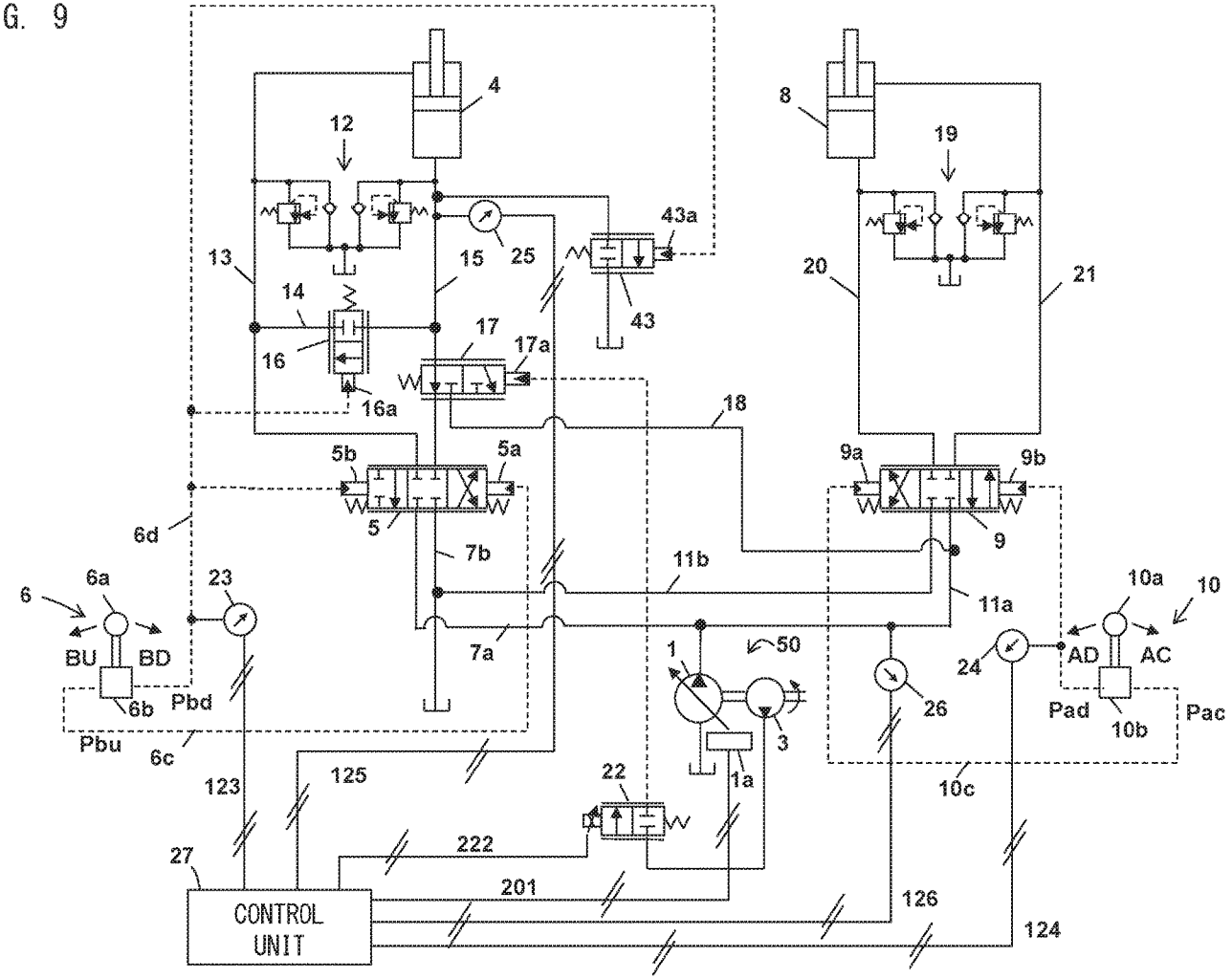
FIG. 9 is a schematic drawing of a control system showing a fourth embodiment of the hydraulic drive system for a work machine of the present invention.

A fourth embodiment of the hydraulic drive system for a work machine of the present invention will be described below, referring to the drawing. FIG. 9 is a schematic drawing of a control system showing the fourth embodiment of the hydraulic drive system for a work machine of the present invention. In FIG. 9, the parts denoted by the same reference symbols as used in FIGS. 1 to 8 are the same parts as those in FIGS. 1 to 8, and, therefore, detailed descriptions of them will be omitted.

The fourth embodiment of the hydraulic drive system for a work machine of the present invention differs from the first embodiment in that, in the bottom-side line 15 between the regeneration control valve 17 and the bottom-side hydraulic chamber of the boom cylinder 4 shown in FIG. 1, there is provided a control valve 43 which is configured such that the hydraulic fluid discharged from the bottom-side hydraulic chamber of the boom cylinder 4 can be discharged to the tank. In the present embodiment, a regeneration flow rate adjustment device is composed of the regeneration control valve 17, and a discharge flow rate adjustment device is composed of the regeneration control valve 17 and the control valve 43.

The control valve 43 has an operation section 43*a*, is opened by transmission of the operation pilot pressure Pbd in the boom lowering direction BD of the first operation device 6 to the operation section 43*a*, and discharges to the tank the hydraulic fluid discharged from the bottom-side hydraulic chamber of the boom cylinder 4. The opening area of the control valve 43 is set to be sufficiently smaller than the opening area of the control valve 5 that is connected to the tank line 7*b*.

With the configuration in the present embodiment, it is ensured that even in the case where, for example, the regeneration control valve 17 is unintendedly switched over due to a failure of the control unit 27 or the like during a sole operation of boom lowering with the control valve 9 in a closed state and where the place for discharging the hydraulic fluid from the bottom-side hydraulic chamber is lost, the hydraulic fluid can be discharged via the control valve 43, so that an abrupt stop of the boom can be prevented from occurring.

Note that the control valve for supplying hydraulic fluid at the time of a raising operation of the boom cylinder 4 is often composed of two or more control valves. Therefore, a configuration may be adopted wherein one of the two or more control valves is provided with such a function as that of the control valve 43 described above. In this case, it is unnecessary to additionally provide the control valve 43 on the circuit, and the control valve disposed conventionally can be used for this purpose.

According to the fourth embodiment of the hydraulic drive system for a work machine of the present invention, substantially the same effects as those of the first embodiment described above can be obtained.

Besides, according to the fourth embodiment of the hydraulic drive system for a work machine of the present invention, a stable operation of the hydraulic drive system for a work machine can be secured even in the case where a failure of the control unit or the like is generated.

In addition, the present invention is not limited to the above-described embodiments, and various modifications are encompassed therein without departing from the gist of the invention. For instance, while a case where the present invention is applied to a hydraulic excavator has been described in the above embodiments, the present invention is also applicable to other work machines such as hydraulic cranes and wheel loaders which include a hydraulic cylinder such that hydraulic fluid is discharged from the bottom side and the hydraulic fluid is sucked into the rod side by falling of a first driven body by its own weight when the first operation device is operated in the direction of falling of the first driven body by its own weight.

DESCRIPTION OF REFERENCE SYMBOLS

1: Hydraulic pump
1*a*: Regulator
3: Pilot pump (Pilot hydraulic fluid source)
4: Boom cylinder (First hydraulic actuator)
5: Control valve
6: First operation device
6*a*: Operation lever
6*b*: Pilot valve
6*c*, 6*d*: Pilot line
8: Arm cylinder (Second hydraulic actuator)
9: Control valve
10: First operation device
10*a*: Operation lever
10*b*: Pilot valve
10*c*, 10*d*: Pilot line
7*a*, 11*a*: Hydraulic fluid supply line
7*b*, 11*b*: Tank line
12: Over-load relief valve with make-up
13: Rod-side line
14: Communication line
15: Bottom-side line
16: Communication control valve
17: Regeneration control valve
18: Regeneration line
19: Over-load relief valve with make-up
20: Bottom-side line
21: Rod-side line
22: Solenoid proportional valve (Electric drive device)
27: Control unit
40: Regeneration-side control valve
41: Tank-side control valve
42: Regeneration control valve
43: Control valve
123: Lever operation signal
124: Lever operation signal
125: Bottom pressure signal
126: Pump pressure signal
130: Adder
131: Function generator
133: Function generator
134: Function generator
135: Function generator
136: Multiplier
138: Multiplier
139: Function generator
140: Multiplier
142: Multiplier
144: Adder
146: Output conversion section
201: Tilting command
222: Solenoid valve command
203: Front work implement
205: Boom (First driven body)
206: Arm (Second driven body)
207: Bucket

The invention claimed is:

1. A hydraulic drive system for a work machine, comprising:

a hydraulic pump device;

a first hydraulic actuator that is supplied with hydraulic fluid from the hydraulic pump device and drives a first driven body;

a second hydraulic actuator that is supplied with the hydraulic fluid from the hydraulic pump device and drives a second driven body;

a first flow rate adjustment device that controls flow of the hydraulic fluid supplied from the hydraulic pump device to the first hydraulic actuator;

a second flow rate adjustment device that controls flow of the hydraulic fluid supplied from the hydraulic pump device to the second hydraulic actuator;

a first operation device that outputs an operation signal for commanding an operation of the first driven body and switches over the first flow rate adjustment device; and a second operation device that outputs an operation signal for commanding an operation of the second driven body and switches over the second flow rate adjustment device, the first hydraulic actuator being a hydraulic cylinder that discharges the hydraulic fluid from a bottom-side hydraulic chamber and sucks the hydraulic fluid into a rod-side hydraulic chamber by falling of the first driven body by a weight thereof when the first operation device is operated in the direction of falling of the first driven body by the weight thereof, wherein the hydraulic drive system further comprises:

a regeneration line that connects the bottom-side hydraulic chamber of the hydraulic cylinder to a portion between the hydraulic pump device and the second hydraulic actuator;

a regeneration flow rate adjustment device that supplies, at an adjusted flow rate, at least part of the hydraulic fluid discharged from the bottom-side hydraulic chamber of the hydraulic cylinder to a portion between the hydraulic pump device and the second hydraulic actuator through the regeneration line;

a discharge flow rate adjustment device that discharges, at an adjusted flow rate, at least part of the hydraulic fluid discharged from the bottom-side hydraulic chamber of the hydraulic cylinder to a tank;

one electric drive device that simultaneously controls the regeneration flow rate adjustment device and the discharge flow rate adjustment device; and a control unit that outputs a control command to the electric drive device such that a falling speed of the first driven body does not vary depending on the magnitude of the regeneration flow rate caused by the regeneration flow rate adjustment device, and the control unit is configured to control an opening area of the regeneration control valve according to a differential pressure between a pressure in the bottom-side hydraulic chamber of the first hydraulic actuator and a delivery pressure of the hydraulic pump device such that the opening area of the regeneration-side line is enlarged as the differential pressure increases, and wherein the regeneration flow rate adjustment device is a regeneration valve that adjusts the regeneration flow rate, whereas the discharge flow rate adjustment device is a discharge valve that adjusts the discharge flow rate, the electric drive device is a solenoid valve that reduces a primary pressure of pilot hydraulic fluid supplied from a pilot hydraulic fluid source to a desired secondary pressure, and the regeneration valve and the discharge valve are configured to be simultaneously controlled by the secondary pressure of the solenoid valve.

2. A hydraulic drive system for a work machine, comprising:

a hydraulic pump device;

a first hydraulic actuator that is supplied with hydraulic fluid from the hydraulic pump device and drives a first driven body;

a second hydraulic actuator that is supplied with the hydraulic fluid from the hydraulic pump device and drives a second driven body;

a first flow rate adjustment device that controls flow of the hydraulic fluid supplied from the hydraulic pump device to the first hydraulic actuator;

a second flow rate adjustment device that controls flow of the hydraulic fluid supplied from the hydraulic pump device to the second hydraulic actuator;

a first operation device that outputs an operation signal for commanding an operation of the first driven body and switches over the first flow rate adjustment device; and a second operation device that outputs an operation signal for commanding an operation of the second driven body and switches over the second flow rate adjustment device, the first hydraulic actuator being a hydraulic cylinder that discharges the hydraulic fluid from a bottom-side hydraulic chamber and sucks the hydraulic fluid into a rod-side hydraulic chamber by falling of the first driven body by a weight thereof when the first operation device is operated in the direction of falling of the first driven body by the weight thereof, wherein the hydraulic drive system further comprises:

a regeneration line that connects the bottom-side hydraulic chamber of the hydraulic cylinder to a portion between the hydraulic pump device and the second hydraulic actuator;

a regeneration flow rate adjustment device that supplies, at an adjusted flow rate, at least part of the hydraulic fluid discharged from the bottom-side hydraulic chamber of the hydraulic cylinder to a portion between the hydraulic pump device and the second hydraulic actuator through the regeneration line;

a discharge flow rate adjustment device that discharges, at an adjusted flow rate, at least part of the hydraulic fluid discharged from the bottom-side hydraulic chamber of the hydraulic cylinder to a tank;

one electric drive device that simultaneously controls the regeneration flow rate adjustment device and the discharge flow rate adjustment device; and a control unit that outputs a control command to the electric drive device such that a falling speed of the first driven body does not vary depending on the magnitude of the regeneration flow rate caused by the regeneration flow rate adjustment device, and the control unit is configured to control an opening area of the regeneration control valve according to a differential pressure between a pressure in the bottom-side hydraulic chamber of the first hydraulic actuator and a delivery pressure of the hydraulic pump device such that the opening area of the regeneration-side line is enlarged as the differential pressure increases, the hydraulic drive system further comprising:

a communication line that enables the hydraulic fluid discharged from the bottom-side hydraulic chamber of the hydraulic cylinder to be supplied to the rod-side hydraulic chamber of the hydraulic cylinder; and a communication control valve that is provided in the communication line and is opened based on an operation signal in the direction of falling of the first driven body of the first operation device by the weight thereof, wherein the first flow rate adjustment device is a control valve that switches over the communication or interruption between the hydraulic pump device and the bottom-side hydraulic chamber or the rod-side hydraulic chamber of the hydraulic cylinder, according to an operation of the first operation device, and the control valve has a switched position for interrupting between the hydraulic pump device and the rod-side hydraulic chamber of the hydraulic cylinder when the first operation device is operated in the direction of falling of the first driven body by the weight thereof.

* * * * *